US006397020B1

(12) United States Patent
Kim

(10) Patent No.: US 6,397,020 B1
(45) Date of Patent: May 28, 2002

(54) IMAGE PRINTING APPARATUS AND A CONTROL METHOD THEREOF

(75) Inventor: Yong-geun Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/633,859

(22) Filed: Aug. 7, 2000

(30) Foreign Application Priority Data

Nov. 20, 1999 (KR) ..... 99-51743

(51) Int. Cl.[7] ..... G03G 15/00; G03G 21/00
(52) U.S. Cl. ..... 399/45; 399/16
(58) Field of Search ..... 399/45, 14, 16, 399/38, 81, 382, 389, 390, 307; 271/265.01

(56) References Cited

U.S. PATENT DOCUMENTS

| | | | | |
|---|---|---|---|---|
| 5,053,814 A | * | 10/1991 | Takano et al. | 399/45 X |
| 5,067,835 A | * | 11/1991 | Yamamoto et al. | 271/265.01 X |
| 5,287,158 A | * | 2/1994 | Nagashima et al. | 399/14 |
| 5,627,354 A | * | 5/1997 | Schneider et al. | 235/375 |
| 5,887,219 A | * | 3/1999 | Eom | 399/45 |
| 6,002,891 A | * | 12/1999 | Shin | 399/45 |
| 6,069,641 A | * | 5/2000 | Matsuno et al. | 347/115 |
| 6,137,967 A | * | 10/2000 | Laussermair et al. | 399/16 |
| 6,219,498 B1 | * | 4/2001 | Katoh et al. | 399/45 |

FOREIGN PATENT DOCUMENTS

JP 10-186707 * 7/1998

* cited by examiner

*Primary Examiner*—Sophia S. Chen
(74) *Attorney, Agent, or Firm*—Robert E. Bushnell, Esq.

(57) ABSTRACT

An image printing apparatus and a controlling method thereof capable of outputting optimum images adjusted in accordance with characteristics of the printing material used, including: a photosensitive section for forming a latent electrostatic image; a charging section for charging the photosensitive section; an exposing section for forming the latent electrostatic image of a certain pattern by projecting a laser beam onto the photosensitive section which is charged by the charging section, and by selectively eliminating any residue of electric charge of the photosensitive section; a developing section for developing the latent electrostatic image by applying a developer onto the latent electrostatic image formed on the photosensitive section; a transferring/fixing section for transferring the image developed by the developing section to a printing material; a printing material feeding section for sequentially supplying the printing material to the transferring/fixing section; a data reading section for reading printing material data recorded on the printing material which is fed by the printing material feeding section; and a controlling section for controlling the above components of the image printing apparatus, and for determining the printability of the printing material based on the data about the printing material which are read by the data reading section, and when the printing material is determined as being acceptable, for setting functional set values for the respective above components of the image printing apparatus in accordance with the characteristics of the printing material to output optimum images. Since controlling parameters for the respective components are reset in accordance with the characteristics of the printing material, optimum images can be fully guaranteed when printing the printing material.

31 Claims, 4 Drawing Sheets

IMAGE PRINTING APPARATUS AND A CONTROL METHOD THEREOF

This application makes reference to, incorporates the same herein, and claims all benefits accruing under 35 U.S.C. §119 from my application APPARATUS FOR PRINTING IMAGE AND METHOD FOR CONTROLLING THEREOF filed with the Korean Industrial Property Office on Nov. 20, 1999 and there duly assigned Serial No. 51743/1999.

BACKGROUND OF THE INVENTION

1. Field of the Invention

The present invention relates to an image printing apparatus, and more particularly, to an image printing apparatus and a control method thereof capable of outputting an optimum image adjusted in accordance with characteristics of the printing material by reading the characteristics of the printing material, and by resetting functional set values for respective components of the image printing apparatus, and by performing the printing operation accordingly.

2. Description of the Related Art

Generally, an image printing apparatus such as a printer, etc. forms characters or images on printing material in accordance with image data signals conveyed from an external device such as a computer, etc. Such an image printing apparatus includes a photosensitive section for forming latent electrostatic images, a charging section for charging the photosensitive section, an exposing section for forming latent electrostatic images of a certain pattern by projecting a beam on and selectively eliminating electric charges on the charged photosensitive section, a developing section for developing the latent electrostatic image by applying developer on the latent electrostatic image, a transferring/fixing section for transferring the developed image by pressing and heating processes, a printing material feeding section for sequentially feeding the printing material to the transferring/fixing section, and a controlling section for controlling the above-mentioned sections.

One example of a wet type electrophotographic image printing apparatus includes a photosensitive belt as the photosensitive section, which is wrapped around rollers disposed within a body frame and which rotatably travels a certain path. Around the photosensitive belt, an antistatic electrostatic unit, a charging unit, an exposing unit, a developing unit, a drying unit, and a transferring/fixing unit are installed.

Further, the wet type electrophotographic image printing apparatus includes a developing fluid supplying unit for constantly supplying the developing fluid of a certain density to the developing unit, a printing material feeding unit for sequentially feeding the printing material to the transferring/fixing unit, and a controlling section for controlling the respective units described above.

The electrostatic unit completely eliminates any electric charge left on the photosensitive belt, and the charging unit newly charges the photosensitive belt. The exposing unit forms a latent electrostatic image on the photosensitive belt by selectively eliminating electric charge of the area where the image is formed on the charged photosensitive belt in accordance with the pattern of the image. The exposing unit includes a plurality of laser projecting devices corresponding to a plurality of colors such as yellow, magenta, cyan, and black, or the like for projecting laser beams toward the photosensitive belt.

The developing unit forms a visual image by projecting the developing fluid composed of a toner in a solid state and a carrier in a liquid state, and thus attaching the toner on the latent electrostatic image on the surface of the photosensitive belt. The developing unit includes four developing devices corresponding to the respective colors. Each developing device includes a pair of developing rollers and a pair of squeezing rollers. Here, the pair of squeezing rollers eliminate the carrier in the developing fluid by squeezing out the carrier from the developing fluid.

The drying unit eliminates the residue of carrier which is still left after the developing unit is to an extent that allows image transferring at the transferring/fixing unit. The drying unit includes a drying roller, and a pair of regeneration rollers which are selectively rotated in tight contact with the drying roller. Further, the transferring/fixing unit transfers the image developed on the photosensitive belt to the printing material fed by the printing material feeding unit, and includes a transferring roller and a fixing roller.

The printing material feeding unit includes a feeding cassette for receiving and storing the printing materials, a printing material feeding path extending from the feeding cassette to the transferring/fixing unit, a pickup roller for picking up one of the printing materials stored in the feeding cassette and for putting the printing material on the printing material feeding path, a plurality of feeding rollers for feeding the printing material entered in the printing material feeding path, an aligning roller for aligning the printing material fed by the feeding roller on the front end of the transferring/fixing unit, printing material delay sensing sensors for sensing the delay of the printing material feeding, and a driving section for driving the respective rollers.

The controlling section controls the above-mentioned units in accordance with a certain program, while determining whether the feeding of printing material is delayed or not by the sensed results inputted from the printing material delay sensing sensors. The controlling section stops the printing operation and indicates a jam error, when there is a delay in printing material feeding.

In a conventional wet type electrophotographic image printing apparatus, when a printing command is applied, the electrostatic unit is operated to eliminate the residual electric charge of the photosensitive belt, and the charging unit sequentially charges the surface of the photosensitive belt with a certain electric potential (approximately of 500–700V).

After that, the exposing unit forms a latent electrostatic image by projecting a laser beam which is converted in accordance with the electric data of the to-be printed area of the charged photosensitive belt, and the latent electrostatic image is developed as the same passes through the developing unit.

Through the above processes, the image developed on the photosensitive belt by the toner, is transferred to the transferring roller as the image passes through the transferring/fixing unit. The image transferred to the transferring roller is transferred to the printing material passing between the transferring and fixing rollers, and the image is completely attached to the printing material by the heat and pressure from the fixing roller.

Here, one of the printing materials is picked up by the pickup roller from the feeding cassette, and is fed to the aligning roller by the plurality of feeding rollers, and is stopped at the aligning roller. Then as the photosensitive belt is rotated a distance corresponding to the distance from the contact point of the transferring and fixing rollers to the aligning roller, thus the image on the photosensitive belt reaches the contact point of the transferring and fixing rollers, the aligning roller is rotated, and the printing material is fed between the transferring and fixing rollers. The printing material, which is printed with the image while passing between the transferring and fixing rollers, is stored in a distributing tray, finally.

As described above, printing is basically the process in which the developer, i.e., the toner is attached to the printing material. In view of this, it is apparent that the printing quality seriously depends on the various characteristics of the printing material, such as thickness, surface roughness, glossiness, material type, conductivity, etc., and the maintenance status of the printing material, in particular, whether the term of use of the printing material has expired or not (that is, if the expiration date has passed), etc. Accordingly, it is necessary to adjust functional set values for the respective components of the image printing apparatus in accordance with the characteristics of the printing material, such as the voltage for charging unit, level of laser beam for the exposing unit, the voltage for the developing unit, developing fluid density, and temperature for fixing process, etc.

The conventional image printing apparatus, however, has fixed functional set values for the respective parts of the image printing apparatus, so that precise values of the parameters for the respective printing material can not be guaranteed, and accordingly, the optimum image adjusted in accordance with the individual characteristics of the printing material can not be guaranteed.

Meanwhile, some of the conventional image printing apparatuses enable a user to directly or indirectly input functional set values for the respective parts of the image printing apparatus. Such an image printing apparatus, however, has a shortcoming in that the manual inputting process is bothersome for the user, and the user can not print an optimum image when the user does not know the exact characteristics of the printing material (such as when using a sheet of printing material whose characteristics are not indicated) since the user can not set the exact functional set values for the printing material.

SUMMARY OF THE INVENTION

It is therefore an object of the invention to provide an improved printing apparatus and method.

A further object of the invention is to provide a printing apparatus and method which automatically adjusts the printing based on the characteristics of the printing material.

A yet further object of the invention is to provide a printer which can discriminate between different types of printing materials.

A still further object of the invention is to provide a printer which can discriminate between different brands of printing materials.

A still yet further object is to provide a printer which can discriminate printing materials which have passed their expiration date.

Another object of the invention is to provide a printer which can avoid damage to the printer from inappropriate printing materials.

The present invention has been developed to overcome the above-mentioned problems of the prior art and to achieve the above objects by providing an image printing apparatus and a control method thereof capable of outputting an optimum image by reading the characteristic data of the printing material, and automatically resetting the functional set values for the respective functional parts of the image printing apparatus in accordance with characteristics of the printing material, and by performing the printing operation accordingly.

The above objects are accomplished by an image printing apparatus according to the present invention, including: a photosensitive section for forming a latent electrostatic image; a charging section for charging the photosensitive section; an exposing section for forming the latent electrostatic image of a certain pattern by projecting a laser beam onto the photosensitive section which is charged by the charging section, and by selectively eliminating the electric charge of the photosensitive section; a developing section for developing the latent electrostatic image by applying developer onto the latent electrostatic image formed on the photosensitive section; a transferring/fixing section for transferring the image developed by the developing section to a printing material; a printing material feeding section for sequentially supplying the printing material to the transferring/fixing section; a data reading section for reading printing material data recorded on the printing material which is fed by the printing material feeding section; and a controlling section for controlling the above components of the image printing apparatus, and for determining the printability of the printing material based on the data about the printing material which are read by the data reading section, and when the printing material is determined as acceptable, for setting functional set values for the respective components of the image printing apparatus in accordance with the characteristics of the printing material to output an optimum image.

Here, the data about the printing material are recorded in the form of a bar code, and the data reading section is formed of a reflective photo sensor for detecting the data about the printing material by projecting a laser beam onto the bar code and converting the reflected laser beam into electric pulse signals. The data about the printing material include both of data about maintenance such as the brand name, model name, manufacturer's name, manufacturing date, durability, and term of use (expiration date), and data about the characteristics of the printing material such as the size, thickness, material type, surface roughness, glossiness, permittivity, and conductivity. Among these, the data displaying section selectively displays one of the model name, brand name, or the manufacturer's name.

According to the preferred embodiment of the present invention, the photosensitive section is formed of a photosensitive belt wrapped around a plurality of belt rollers disposed within the body frame to travel a certain path, and further includes an antistatic section for eliminating residual electric charge on the photosensitive belt.

Further, the image printing apparatus according to the present invention further includes a data displaying section for displaying one of data about the printing material read by the data reading section, and more specifically, the data displaying section selectively displays one of the model name, brand name, or the manufacturer's name.

Further, the image printing apparatus according to the present invention further includes an alarm section for letting the user know when the printing material is determined as unacceptable for printing by the controlling section, and a user input section for inputting commands from the user whether to proceed the printing ignoring the alarm of the alarm section, or cancel the printing, or print the image on another printing material.

Meanwhile, a controlling method for the image printing apparatus according to the present invention includes steps of: a) reading the data about the printing material which is fed; b) determining the printability of the printing material by the data about the printing material read from step a); and c) performing the printing process by resetting the functional set values for the components of the image printing apparatus in accordance with the characteristics of the printing material when determining the printing material as acceptable for printing, and temporally stopping the printing process when determining that the printing material is unacceptable for printing.

Here, the printability of the printing material is determined by comparing the data about the printing material read by the data reading section with standard data prestored in a memory of the image printing apparatus.

According to the preferred embodiment of the present invention, the controlling method of the image printing apparatus further includes a step for selectively displaying one of the model name, brand name, or the manufacturer's name of the printing material which are read from step a).

Further, the controlling method of the image printing apparatus according to the present invention further includes step e) for selectively displaying one of the model name, brand name, or the manufacturer's name, while simultaneously displaying an alarm or error message when the printing material is determined as being unacceptable for printing in step c).

When the alarm and error message are displayed, the user can select whether to proceed with the printing, or cancel the printing, or continue printing onto another printing material. Accordingly, upon receipt of the printing proceed command, printing is performed, ignoring the data about the printing material read by the data reading section, in accordance with the functional set values for the respective components of the image printing apparatus which are initially set, or, upon receipt of the printing cancel command, the image is not printed on the printing material, and the prepared printing data are erased, and the printing material is put out, or, upon receipt of printing command onto another printing material, new printing material is fed and the data about the newly fed printing material are read after the exit of the printing material which was initially fed.

Accordingly, while determining the printability of the printing material by reading the characteristics of the printing material, the image printing apparatus performs printing by resetting the functional set values for the respective parts thereof in accordance with the characteristics of the printing material, so that the optimum image adjusted in accordance with the characteristics of the printing material can be outputted.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF TIM PREFERRED EMBODIMENTS

Figure 1:
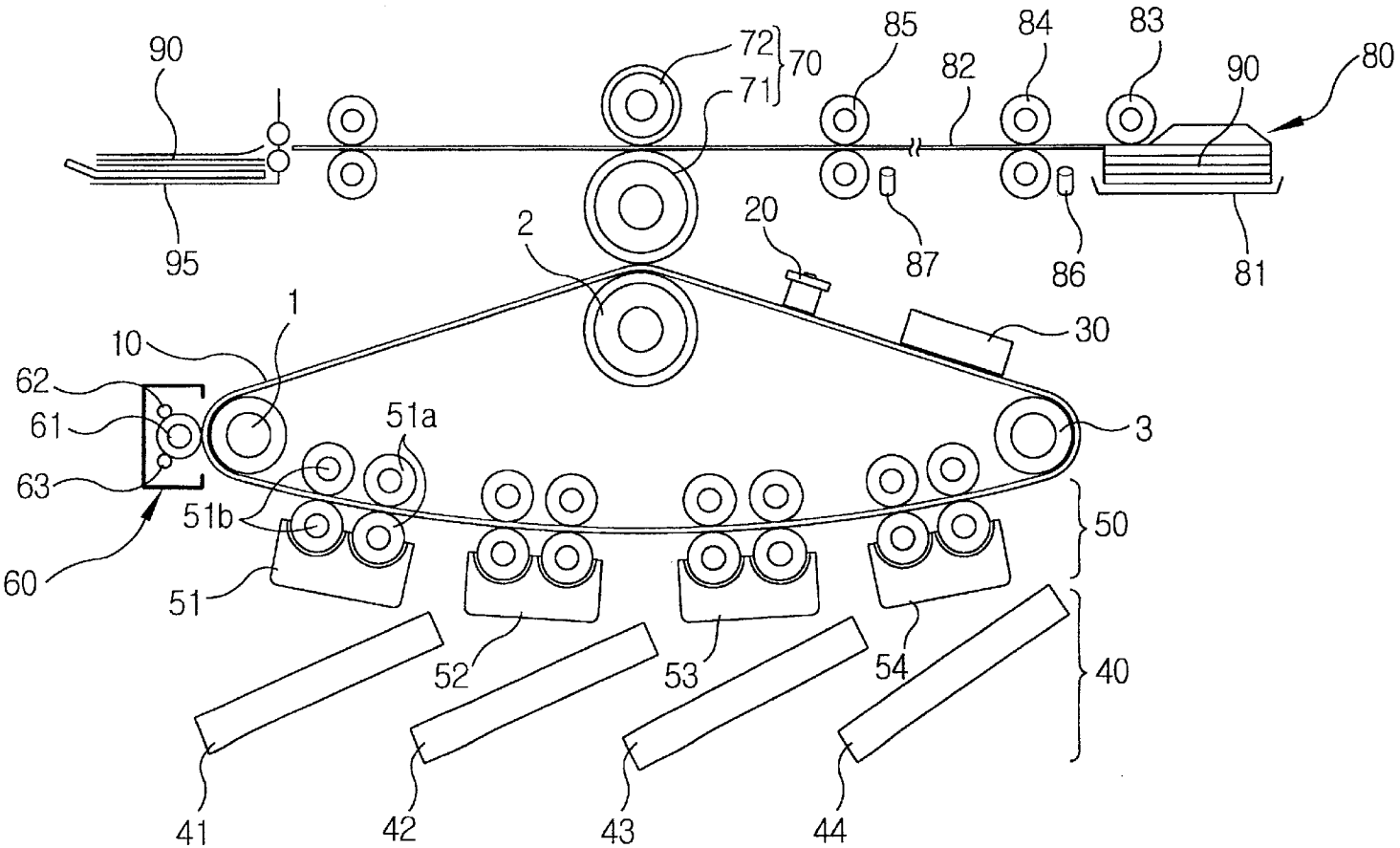
FIG. 1 (PRIOR ART)
FIG. 1 is a schematic view for showing the main portion of a conventional wet type electrophotographic image printing apparatus.

Turning now to the drawings, FIG. 1 shows the example of a wet type electrophotographic image printing apparatus discussed above, which will be described below. As shown in FIG. 1, the wet type electrophotographic image printing apparatus includes a photosensitive belt 10 as the photosensitive section, which is wrapped around rollers 1, 2, and 3 disposed within a body frame (not shown), and rotatably travels a certain path. Around the photosensitive belt 10, an antistatic electrostatic unit 20, a charging unit 30, an exposing unit 40, a developing unit 50, a drying unit 60, and a transferring/fixing unit 70, are installed.

Further, the wet type electrophotographic image printing apparatus as shown includes a developing fluid supplying unit (not shown) for constantly supplying the developing fluid of a certain density to the developing unit 50, a printing material feeding unit 80 for sequentially feeding the printing material to the transferring/fixing unit 70, and a controlling section (not shown) for controlling the respective units described above.

The electrostatic unit 20 completely eliminates any electric charge left on the photosensitive belt 10, and the charging unit 30 newly charges the photosensitive belt 10. The exposing unit 40 forms a latent electrostatic image on the photosensitive belt 10 by selectively eliminating electric charge of the area where the image is formed on the charged photosensitive belt 10 in accordance with the pattern of the image. The exposing unit 40 includes a plurality of laser projecting devices 41, 42, 43, and 44 corresponding to a plurality of colors such as yellow, magenta, cyan, and black, or the like for projecting laser beams toward the photosensitive belt 10.

The developing unit 50 forms a visual image by projecting the developing fluid composed of a toner in a solid state and a carrier in a liquid state, and thus attaching the toner on the latent electrostatic image on the surface of the photosensitive belt 10. The developing unit 50 includes four developing devices 51, 52, 53, and 54 corresponding to the respective colors. Each developing device includes a pair of developing rollers 51*a* and a pair of squeezing rollers 51*b*. Here, the pair of squeezing rollers 51*b* eliminate the carrier in the developing fluid by squeezing out the carrier from the developing fluid.

The drying unit 60 eliminates the residue of carrier which is still left after the developing unit 50 to an extent that allows image transferring at the transferring/fixing unit 70. The drying unit 60 includes a drying roller 61, and a pair of regeneration rollers 62 and 63 which are selectively rotated in tight contact with the drying roller 61. Further, the transferring/fixing unit 70 transfers the image developed on the photosensitive belt 10 to the printing material 90 fed by the printing material feeding unit 80, and includes a transferring roller 71 and a fixing roller 72.

The printing material feeding unit 80 includes a feeding cassette 81 for receiving and storing the printing materials 90, a printing material feeding path 82 extending from the feeding cassette 81 to the transferring/fixing unit 70, a pickup roller 83 for picking up one of the printing materials stored in the feeding cassette 81 and for putting the printing material on the printing material feeding path 82, a plurality of feeding rollers 84 for feeding the printing material entered in the printing material feeding path 82, an aligning roller 85 for aligning the printing material fed by the feeding roller 84 on the front end of the transferring/fixing unit 70, printing material delay sensing sensors 86 and 87 for sensing the delay of the printing material feeding, and a driving section (not shown) for driving the respective rollers 83, 84, and 85.

The controlling section controls the above-mentioned units in accordance with a certain program, while determining whether the feeding of printing material is delayed or not by the sensed results inputted from the printing material delay sensing sensors 86 and 87. The controlling section stops the printing operation and indicates a jam error, when there is a delay in printing material feeding.

In a conventional wet type electrophotographic image printing apparatus, when a printing command is applied, the electrostatic unit 20 is operated to eliminate the residual electric charge the photosensitive belt 10, and the charging unit 30 sequentially charges the surface of the photosensitive belt 10 with a certain electric potential (approximately of 500–700V).

After that, the exposing unit 40 forms a latent electrostatic image by projecting a laser beam which is converted in accordance with the electric data of the to-be printed area of the charged photosensitive belt 10, and the latent electrostatic image is developed as the same passes through the developing unit 50.

Through the above processes, the image developed on the photosensitive belt 10 by the toner, is transferred to the transferring roller 71 as the image passes through the transferring/fixing unit 70. The image transferred to the transferring roller 71 is transferred to the printing material 90 passing between the transferring and fixing rollers 71 and 72, and the image is completely attached to the printing material 90 by the heat and pressure from the fixing roller 72.

Here, one of the printing materials 90 is picked up by the pickup roller 83 from the feeding cassette 81, and is fed to the aligning roller 85 by the plurality of feeding rollers 84, and is stopped at the aligning roller 85. Then as the photosensitive belt 10 is rotated a distance corresponding to the distance from the contact point of the transferring and fixing rollers 71 and 72 to the aligning roller 85, thus the image on the photosensitive belt 10 reaches the contact point of the transferring and fixing rollers 71 and 72, the aligning roller 85 is rotated, and the printing material 90 is fed between the transferring and fixing rollers 71 and 72. The printing material 90, which is printed with the image while passing between the transferring and fixing rollers 71 and 72, is stored in a distributing tray 95, finally.

As described above, printing is basically the process in which the developer, i.e., the toner is attached to the printing material 90. In view of this, it is apparent that the printing quality seriously depends on the various characteristics of the printing material, such as thickness, surface roughness, glossiness, material type, conductivity, etc., and the maintenance status of the printing material 90, in particular, whether the term of use of the printing material 90 has expired or not, etc. Accordingly, it is necessary to adjust functional set values for the respective components of the image printing apparatus in accordance with the characteristics of the printing material 90, such as the voltage for charging unit 30, level of the laser beam for the exposing unit 40, the voltage for the developing unit 60, developing fluid density, and temperature for the fixing process, etc.

The conventional image printing apparatus, however, has fixed functional set values for the respective parts of the image printing apparatus, so that precise values for the characteristics of the respective printing material 90 can not be guaranteed, and accordingly, the optimum image adjusted in accordance with the individual characteristics of the printing material 90 can not be guaranteed.

Meanwhile, some of the conventional image printing apparatuses enable a user to directly or indirectly input functional set values for the respective parts of the image printing apparatus. Such an image printing apparatus, however, has a shortcoming in that the manual inputting process is bothersome for the user, and the user can not print an optimum image when the user does not know the exact characteristics of the printing material 90 (such as when using a sheet of printing material whose characteristics are not indicated) since the user can not set the exact functional set values for the printing material 90.

Reference will now be made in detail to the preferred embodiments of the present invention, examples of which are illustrated in the accompanying drawings, wherein like reference numerals refer to like elements throughout.

Figure 2:
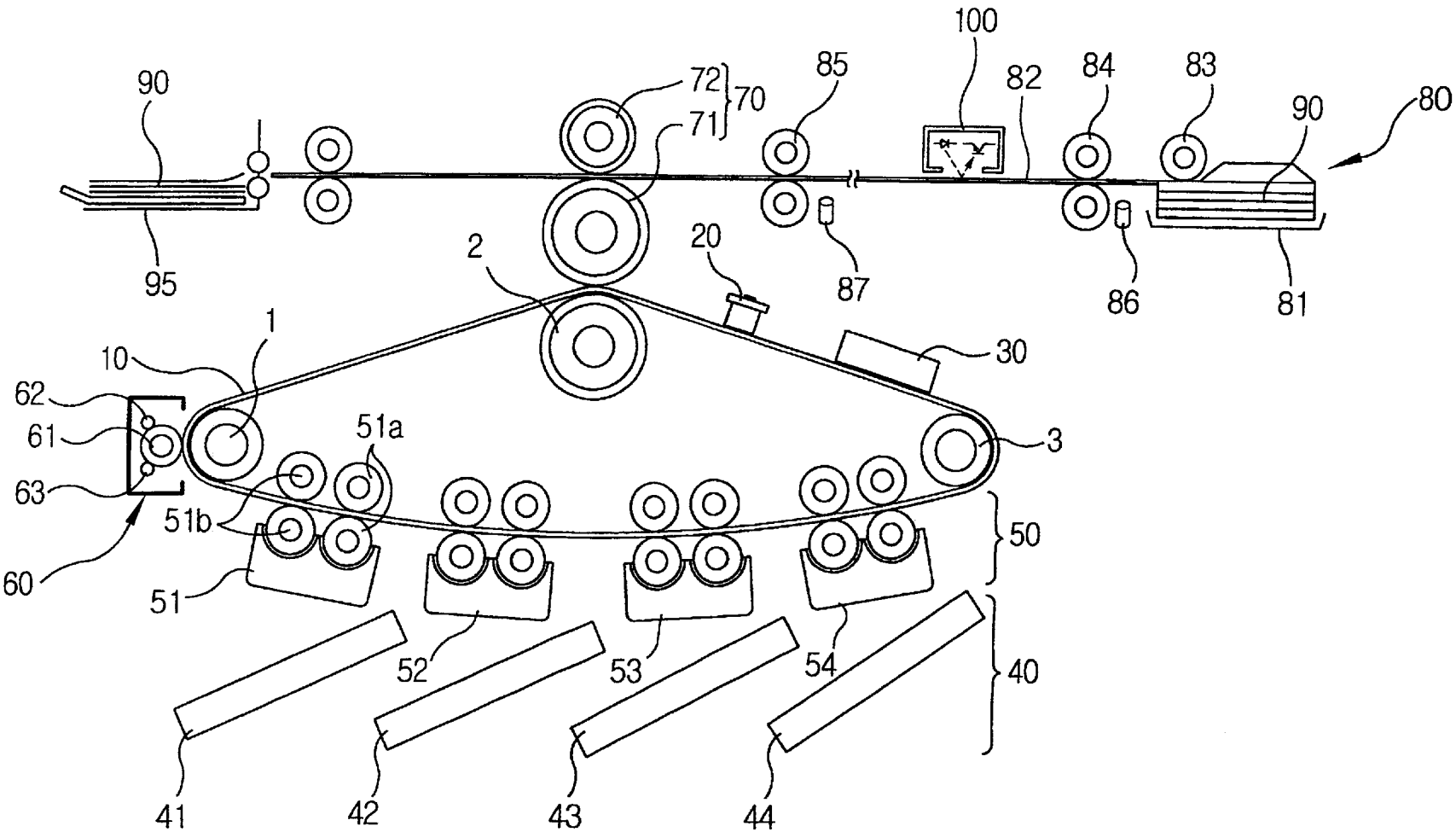
FIG. 2 is a schematic view for showing the main portion of a wet type electrophotographic image printing apparatus according to a preferred embodiment of the present invention.
Figure 3:
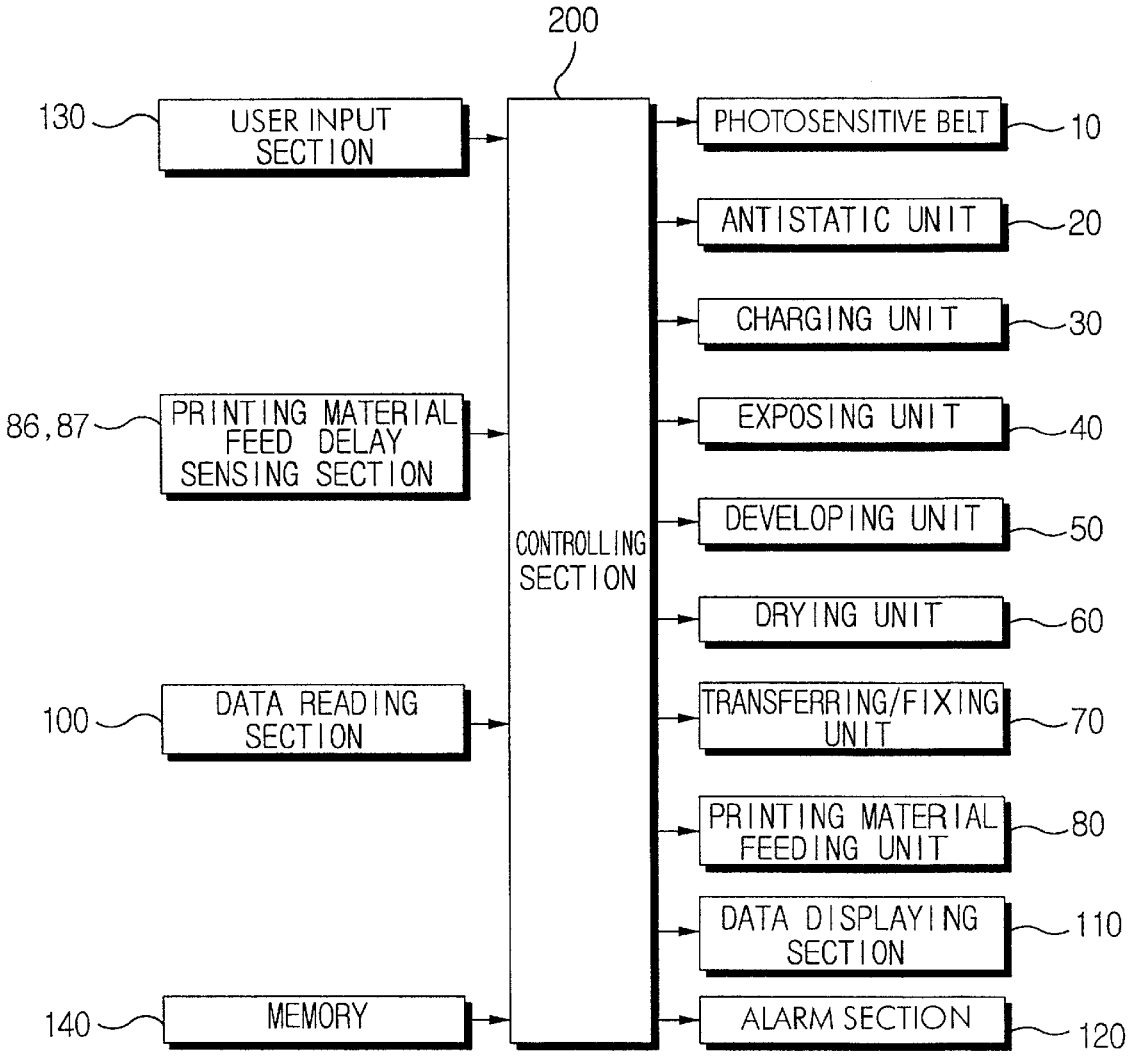
FIG. 3 is a control block diagram of the image printing apparatus shown in FIG. 2.
Figure 4:
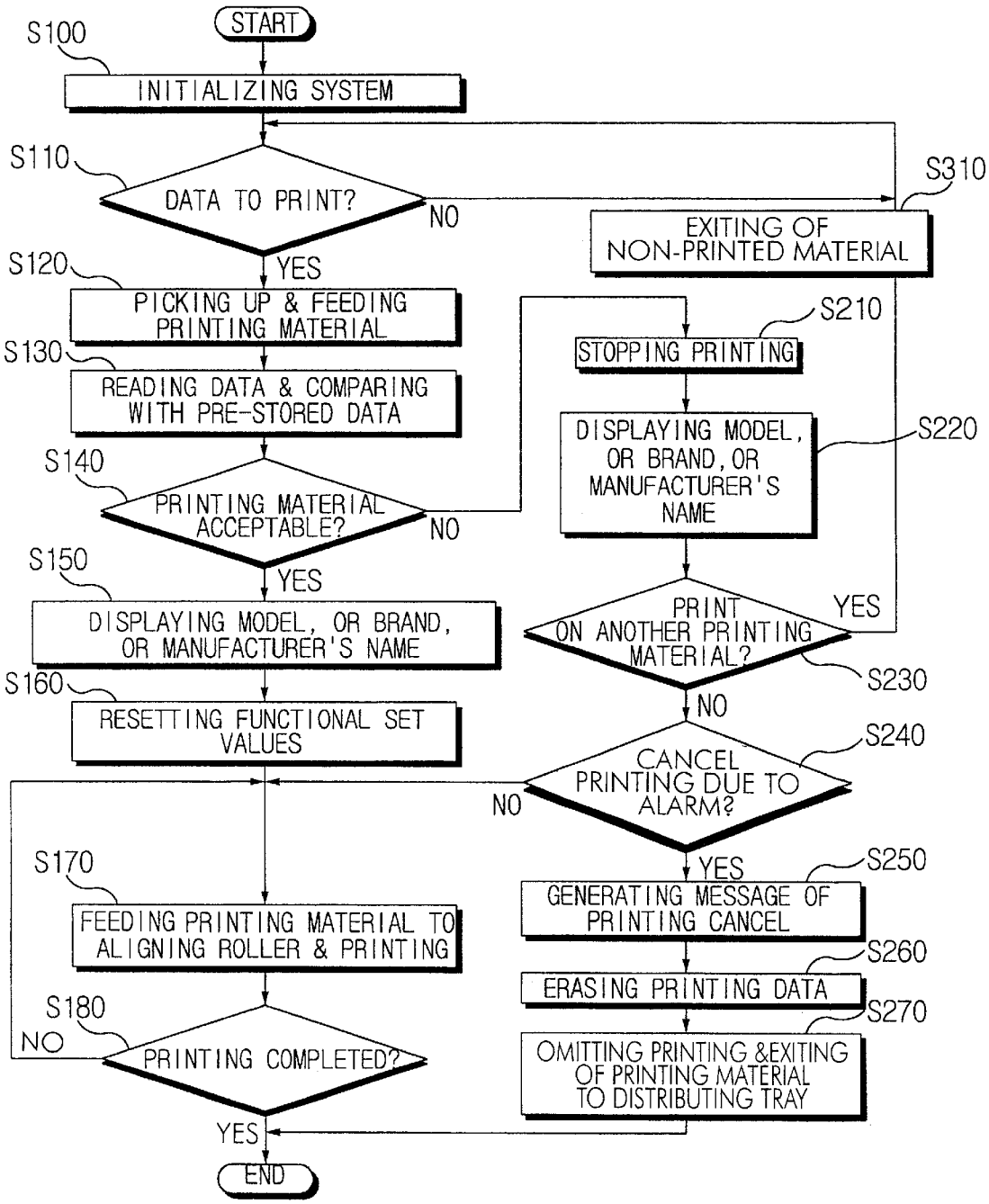
FIG. 4 is a flow chart for explaining a control method for the wet type electrophotographic image printing apparatus according to the preferred embodiment of the present invention.

FIG. 2 is a schematic view for showing the main portion of a wet type electrophotographic image printing apparatus according to a preferred embodiment of the present invention, FIG. 3 is a control block diagram of the image printing apparatus shown in FIG. 2, and FIG. 4 is a flow chart for explaining a control method for the wet type electrophotographic image printing apparatus according to the preferred embodiment of the present invention.

As shown in FIGS. 2 and 3, an image printing apparatus according to the present invention includes a photosensitive belt 10 as a photosensitive section which is wrapped around rollers 1, 2, and 3 disposed within a body frame (not shown) to rotatably travel a certain path. Around the photosensitive belt 10, an antistatic unit 20, a charging unit 30, an exposing unit 40, a developing unit 50, a drying unit 60, and a transferring/fixing unit 70 are installed.

Further, the image printing apparatus according to the present invention further includes a developing fluid supplying unit (not shown) for constantly supplying the developing fluid of a certain density to the developing unit 50, a printing material feeding unit 80 for sequentially feeding the printing material to the transferring/fixing unit 70, a data reading section 100 for reading the data about the characteristics of the printing material 90 recorded in the printing material 90 which is fed by the printing material feeding unit 80, and a controlling section 200 for determining the printability of the printing material 90 based on the data about the characteristics read by the data reading section 100, and for determining the functional set values for the respective components of the image printing apparatus to output an optimum image adjusted in accordance with the individual characteristics of the printing material 90. The antistatic unit 20 eliminates residual electric charge on the photosensitive belt 10, and the charging unit 30 newly charges the photosensitive belt 10.

The exposing unit 40 forms the latent electrostatic image on the photosensitive belt 10 by selectively eliminating the electric charge of the image area on the photosensitive belt 10 in accordance with a certain image pattern. Such an exposing unit 40 includes four laser projecting devices 41, 42,43, and 44 corresponding to a plurality of colors such as yellow, magenta, cyan, and black, etc., for projecting laser beams toward the photosensitive belt 10.

The developing unit 50 forms visual image by applying developing fluid composed of a toner in a solid state and a carrier in a liquid state onto the photosensitive belt 10, thus, attaching the toner on the latent electrostatic image area on the surface of the photosensitive belt 10. The developing unit 50 includes four developing devices 51, 52, 53, and 54 corresponding to the respective colors. Each developing device includes a pair of developing rollers 51*a* and a pair of squeezing rollers 51*b*. Here, the pair of squeezing rollers 51*b* eliminate the carrier by squeezing out the carrier from the developing fluid.

The drying unit 60 eliminates the residual carrier which is still left after the developing unit 50 to an extent that allows the image transferring at the transferring/fixing unit 70. The drying unit 60 includes a drying roller 61, and a pair of regeneration rollers 62 and 63 which are selectively rotated in tight contact with the drying roller 61. Further, the transferring/fixing unit 70 transfers the image developed on the photosensitive belt 10 to the printing material 90 which is fed by the printing material feeding unit 80, and includes a transferring roller 71 and a fixing roller 72.

The printing material feeding device 80 includes a feeding cassette 81 for receiving and storing the printing material 90, a printing material feeding path 82 extending from the feeding cassette 81 to the transferring/fixing unit 70, a pickup roller 83 for picking up one of printing materials 90 stored in the feeding cassette 81 and for putting the printing material 90 on the printing material feeding path 82, a plurality of feeding rollers 84 for feeding the printing material 90 entered in the printing material feeding path 82, an aligning roller 85 for aligning the printing material 90, which is fed by the feeding rollers 84, at the front end of the transferring/fixing unit 70, a plurality of printing material feeding sensing sensors 86 and 87 for sensing the feeding delay of the printing material 90, and a driving section (not shown) for driving the respective rollers 83, 84, and 85.

The present invention further includes a data reading section 100 positioned on the printing material feeding path 82 of the printing material feeding unit 80, for reading the characteristic data of the printing material 90, which is fed along the printing material feeding path 82, and for delivering the data about the characteristics of the printing material 90 in the form of certain electric signals.

Here, the data about the printing material 90 include both of maintenance data such as the brand name, model name, manufacturer's name, manufacturing data, durability, and expiration date, etc., and characteristic data such as the size, thickness, material type, surface roughness, glossiness, permittivity, and conductivity, etc., all of which are recorded at a certain location of the printing material 90 in the form of a code placed on the printing material. Here, the code may be written in a visible ink and recognized by light and shade. In this case, the data reading section 100 is formed of a reflective photo sensor for projecting a laser beam onto the code, and converting the reflected beam into electric pulse signals. Generally, data reading section 100 will use a stationary light source, and the code will be read as the code on the printing material moves by the data reading section.

The data about the printing material 90 may be recorded in the form of bar codes, and the data reading section 100 employs a reflective photo sensor in this embodiment, but the invention is not limited to this embodiment. For example, other forms of scannable codes, such as 2-dimensional scannable codes, may be used instead of bar codes. Other variations, such as using magnetism for forming marks, etc., may be used. In the case of using magnetic ink, the data reading section 100 is formed of a magneto metric sensor. Further, when the printing material 90 is a transparent one such as a film, etc., the data reading section 100 may be formed of a permeable (transmission) photo sensor.

The data code may be included on each piece of printing material from a particular box or lot. Alternatively, the code may appear only on selected pieces of printing material, such as the first piece in a box.

Further, the image printing apparatus according to the present invention may further include a data displaying section 110 for displaying at least one of the data about the printing material 90 which are read by the data reading section 100, and accordingly, the user can readily recognize or identify the printing material 90. Here, the data displayable include model name, brand name, and manufacturer's name.

Further, the image printing apparatus according to the present invention may further include an alarm section 120 for alerting the user when the printing material 90 is determined as unacceptable for printing as a result of the checking operation of the controlling section 200 for the printability of the printing material 90. Accordingly, the user is able to recognize the printability of the printing material 90 very easily. Here, the data displaying section 100 selectively displays the data about model name, brand name, and manufacturer's name of the printing material 90. The printing material 90 is determined as unacceptable for printing when any of the data about the printing material 90 is omitted, when the printing material 90 is manufactured by an unapproved manufacturer, when the term of use of the printing material 90 has expired (expiration date passed), or when the characteristics of the, printing material 90 (such as size, thickness, material type, surface roughness, glossiness, permittivity, and conductivity, etc.) are unacceptable for the smooth operation of the image printing apparatus, or even harming the image printing apparatus.

Further, the image printing apparatus according to the present invention may further include a user input section 130, such as a control panel with buttons, for enabling the user to input his/her desired commands as to whether he/she would proceed with the printing operation ignoring the alarm of the alarm section 120, or cancel the printing operation, or print on another printing material 90.

The controlling section 200 controls all the above-mentioned components of the image printing apparatus in accordance with a certain program, while determining the feeding delay of the printing material 90 by the sensed results inputted from the printing material feed delay sensing sensors 86 and 87. Further, the controlling section 200 determines the printability of the printing material 90 based on the data about the printing material 90 inputted from the data reading section 100, and resets functional set values for the respective components to output an optimum image adjusted in accordance with the data about the printing material 90, i.e., the characteristics of the printing material 90.

In this situation, the functional set values for the respective components include the voltage for the charging unit 30, the level of the laser beam of the exposing unit 40, the voltage for the developing unit 50, the density of the developing fluid, and the temperature for the fixing process of the transferring/fixing unit 70. The controlling section 200 resets the functional set values for the above-mentioned components in accordance with the characteristics of the printing material 90, so that an optimum image can be outputted in accordance with the characteristics of the printing material 90.

Hereinafter, the operation of the image printing apparatus constructed as above according to the present invention will be described in greater detail with reference to the flow chart of FIG. 4. Upon receipt of the electric current, the system is initialized (Step S100), and it is determined whether there are data to be printed or not (Step S110). When there are data to be printed, a sheet of printing material 90 is picked up and is fed along the printing material feeding path 82 (Step S120). In this situation, the data reading section 100 disposed on the printing material feeding path 82 reads the data about the maintenance and characteristics of the printing material 90 which are recorded on the printing material 90, and conveys the corresponding signals to the controlling section 200. Accordingly, the controlling section 200 compares the data about the printing material 90 inputted from the data reading section 100 with data pre-stored in a memory 140 (Step S130), and determines the printability of the printing material 90 (Step S140). More specifically, the controlling section 200 determines whether the printing material 90 has the right characteristics (such as model name, brand name, manufacturer's name, thickness, and material type, etc.) for an optimum image.

After Step S140, when the printing material 90 is determined as acceptable, one of the model name, brand name, or the manufacturer's name is displayed on the data displaying section 110 for the user's reading (Step S150), and the functional set values are set for an optimum image in accordance with the characteristics of the printing immaterial 90 (Step S160). Here, the functional set values set by the program of the controlling section 200 include the charging voltage, developing voltage, level of outputted laser beam, developing fluid density, and temperature for the fixing process.

After the set values for the respective parts are set in accordance with the characteristics of the printing material 90, the printing material 90 is fed to the aligning roller 85 and the image is printed (Step S170). As the printing is completed (Step S180), the process is ended.

As described above, according to the present invention, the data about the printing material 90 are read while the printing material 90 is fed, and the printing is performed in accordance with the control parameters which are set in accordance with the characteristics of the printing material 90 for the optimum image, so that an optimum image can be outputted.

Meanwhile, when the printing material 90 is determined as unacceptable for printing as a result of the determining process of Step S140, printing is temporarily stopped (Step S210). The printing material 90 is determined as unacceptable for printing when the printing material 90 lacks the required data, or when the printing material 90 is manufactured by an unapproved manufacturer, or when the term of use of the printing material 90 has expired, or when there is a possibility that the originally intended performance of the image printing apparatus is hindered by the printing material 90 which is fed, or when there is a possibility that the printing material 90 would damage the image printing apparatus Then, the model name, brand name, or the manufacturer's name is displayed on the data displaying section 110, as necessary, with the alarm message (Step S220).

When the user decides to print the image on another printing material 90 due to the alarm message (Step S230), the printing material 90 is not printed but exits to the distributing tray 95 (Step S310), and another printing material 90 is picked up and fed to undergo the above-described steps of S110, S120, and S130.

Further, after Step S220, when the user decides to cancel the printing operation due to the alarm message (Step S240), the printing cancel message is outputted (Step S250), and the image data is erased (Step S260). The printing material 90 is then not printed, but exits to the distributing tray 95, and the printing cycle is completed (Step S270).

Meanwhile, after Step S220, when the user decides to proceed with printing despite the alarm message, the controlling section 200 ignores the data about the printing material 90, and prints the prepared image on the printing material 90 in accordance with the functional set values which were initially set (Step S170). Upon completion of the printing (Step S170), the whole printing operation is completed, as determined in Step S180.

As described above, according to the present invention, image transference on the unacceptable printing material is prevented, so that the physical harm to the image printing apparatus caused due to the use of unacceptable printing material is prevented.

Further, according to the present invention, since the data about the printing material are read, and the functional set values for the respective parts of the image printing apparatus are automatically set in accordance with the characteristics of the printing material, and printing is performed accordingly, an optimum image can be printed in accordance with the characteristics of the printing material.

Further, according to the present invention, when printing material which can not be used in the image printing apparatus is fed, printing is omitted, and the printing material exits to the distributing tray thereby preventing physical harm to the image printing a apparatus.

Although the preferred embodiment of the present invention has been shown and described, it will be appreciated by those; skilled in the art that changes may be made in these, embodiments without departing from the principles and spirit of the invention, the scope of which is defined in the claims and their equivalents.

What is claimed is:

1. An electrophotographic printing apparatus, comprising:

a transferring/fixing unit for transferring an image onto a printing material;

a printing material feeding unit, the printing material feeding unit comprising:

a feeding cassette for holding the printing material on which an image is to be printed; and a printing material feeding path for feeding the printing material, the printing material feeding path extending from the feeding cassette to the transferring/fixing unit;

a data reading section located in said printing material feeding path for reading a code included on the printing material on which an image is to be printed, the code including code data, the code data including data corresponding to characteristics of the printing material; and a controlling section for controlling printing parameters for printing an image on the printing material in accordance with the characteristics of the printing material in the code data in the code included on the printing material read by the data reading section, the controlling section comprising:

means for omitting printing on the printing material and for directing the printing material to a distributing tray for receiving the printing material based upon the code included on the printing material or when the code is absent from the printing material.

2. The electrophotographic printing apparatus of claim 1, further comprised of the data reading section further comprising:

a reflective photo sensor for reading the code when the code is printed in ink on the printing material.

3. The electrophotographic printing apparatus of claim 2, further comprised of the reflective photo sensor being positioned facing a side of the printing material opposite to a side of the printing material on which an image is to be printed.

4. The electrophotographic printing apparatus of claim 2, further comprised of the reflective photo sensor comprising a laser.

5. The electrophotographic printing apparatus of claim 1, further comprised of the data reading section comprising a magneto metric sensor for reading the code when the code is a magnetic code on the printing material.

6. The electrophotographic printing apparatus of claim 1, further comprised of the data reading section comprising a transmission photo sensor for reading the code on a transparent printing material as the printing material.

7. The electrophotographic printing apparatus of claim 1, further comprised of the controlling section being connected to the data reading section for controlling the printing parameters as a function of the code included on the printing material read by the data reading section.

8. The electrophotographic printing apparatus of claim 1, further comprised of the controlling section further comprising:

means for adjusting at least one printing parameter of the printing parameters for printing an image on the printing material, the printing parameters including: a voltage of a charging unit of the electrophotographic printing apparatus, a level of a laser beam of an exposing unit of the electrophotographic printing apparatus, a voltage of a developing unit of the electrophotographic printing apparatus, a density of a developing fluid in the electrophotographic printing apparatus, and a fixing temperature of the transferring/fixing unit of the electrophotographic printing apparatus.

9. The electrophotographic printing apparatus of claim 1, further comprised of the controlling section further comprising:

means for comparing an expiration date contained in the code included on the printing material to a date, for rejecting the printing material when the printing material is expired.

10. The electrophotographic printing apparatus of claim 1, further comprising:

a data displaying section for displaying information based on the code included on the printing material read by the data reading section.

11. The electrophotographic printing apparatus of claim 1, further comprising:

a memory for storing printing material information corresponding to the code included on the printing material.

12. The electrophotographic printing apparatus of claim 1, further comprising:

an alarm section for indicating when the printing material is determined as unacceptable for printing based upon the code included on the printing material or when the code is absent from the printing material.

13. The electrophotographic printing apparatus of claim 12, further comprising:

a user input section connected to said controlling section, for permitting a user to control printing in response to an alarm from the alarm section.

14. A method of operating an electrophotographic printing apparatus, comprising the steps of:

reading a code included on a printing material, the code including code data, the code data including data corresponding to characteristics of the printing material, while feeding the printing material on a printing material feeding path of the electrophotographic printing apparatus toward a fixing/transferring section of the electrophotographic printing apparatus, the fixing/transferring section for transferring an image onto the printing material;

determining when the printing material is acceptable for printing based upon the code included on the printing material;

stopping a printing operation on the printing material, when the printing material is determined not to be acceptable for printing; and controlling printing parameters for printing an image on the printing material in accordance with the characteristics of the printing material in the code data in the code included on the printing material read in the step of reading a code, when the printing material is determined to be acceptable for printing.

15. The method of claim 14, further comprising the step of:

incorporating the code on the printing material at a time of manufacture of the printing material.

16. The method of claim 15, further comprised of the code being a visible bar code.

17. The method of claim 15, further comprised of the code being a magnetic code.

18. The method of claim 14, further comprised of the step of reading a code further comprising the step of:

passing the printing material by a reflective photo sensor to read the code included on the printing material.

19. The method of claim 14, further comprised of the step of reading a code further comprising the step of:

passing the printing material by a magneto metric sensor to read the code included on the printing material.

20. The method of claim 14, further comprised of the step of reading a code further comprising the step of:

passing the printing material by a transmission photo sensor when the printing material is transparent to read the code included on the printing material.

21. The method of claim 14, further comprising the step of:

comparing expiration date information in the code data in the code included on the printing material to a date for determining when the printing material is passed an expiration date for the printing material.

22. The method of claim 14, further comprising the step of:

comparing the code data in the code included in the printing material to printing material data pre-stored in a memory, for obtaining additional data about the printing material to control a printing operation on the printing material.

23. The method of claim 14, further comprised of the step of controlling printing parameters further comprising the step of:

adjusting at least one parameter of the printing parameters, the printing parameters including: a voltage of a charging unit of the electrophotographic printing apparatus, a level of a laser beam of an exposing unit of the electrophotographic printing apparatus, a voltage of a developing unit of the electrophotographic printing apparatus, a density of a developing fluid in the electrophotographic printing apparatus, and a fixing temperature of the transferring/fixing section of the electrophotographic printing apparatus.

24. The method of claim 14, further comprised of the step of determining when the printing material is acceptable for printing further comprised of:

determining that the printing material is unacceptable for printing when an expiration date of the printing material is passed, when the printing material is not an approved printing material for the electrophotographic printing apparatus, or when an appropriate code is absent from the printing material.

25. The method of claim 14, further comprising the step of:

when the printing material is not acceptable for printing, omitting transfer of an image to the printing material and feeding the printing material to a distributing tray of the electrophotographic printing apparatus.

26. The method of claim 14, further comprising the step of:

when the printing material is not acceptable for printing, sending an alarm message to a user of the electrophotographic printing apparatus.

27. The method of claim 26, further comprising the steps of:

after sending the alarm message to the user of the electrophotographic printing apparatus, receiving an input from the user to determine whether to print on the printing material, print on another printing material or to cancel printing; and printing on the printing material, printing on another printing material or canceling printing in response to the input from the user.

28. The method of claim 26, further comprising the step of:

when the alarm message is sent to the user of the electrophotographic printing apparatus, outputting information to a data displaying section based on the code data in the code included the printing material read in the step of reading a code.

29. The method of claim 28, further comprised of the information output to the data displaying section comprising at least one of a model, a brand or a manufacturer's name of the printing material.

30. The method of claim 14, further comprising the step of:

outputting information to a data displaying section based on the code data in the code included on the printing material read in the step of reading a code.

31. The method of claim 30, further comprised of said information output to the data displaying section comprising at least one of a model, a brand or a manufacturer's name of the printing material.

* * * * *